US005996740A

United States Patent [19]

Wells

[11] Patent Number: 5,996,740

[45] **Date of Patent: *Dec. 7, 1999**

[54] CHECK-OUT COUNTER HAVING A FRONT END MERCHANDISER WITH CHECK-OUT LANE BLOCKER

[75] Inventor: Richard E. Wells, Anaheim, Calif.

[73] Assignee: Felbro, Inc., Los Angeles, Calif.

[ * ] Notice: This patent is subject to a terminal disclaimer.

[21] Appl. No.: 08/972,382

[22] Filed: Nov. 18, 1997

[51] Int. Cl.[6] ..... A47B 96/18; A47F 5/00

[52] U.S. Cl. ..... 186/57; 186/59; 312/140.4; 211/162; 211/94.01

[58] Field of Search ..... 186/57, 59, 68, 186/69; 312/140.4; 211/162, 94.01, 175

[56] References Cited

U.S. PATENT DOCUMENTS 4,368,804 1/1983 Cole ..... 486/57

5,732,834 3/1998 Wells ..... 211/162

*Primary Examiner*—David A. Bucci
*Assistant Examiner*—Bryan Jaketic
*Attorney, Agent, or Firm*—Allan M. Shapiro

[57] ABSTRACT

The check-out counter has a front end merchandiser which has a fixed display rack forming part of the merchandiser. The fixed display rack has merchandise display devices thereon. A movable display rack is movably mounted with respect to the display rack. The movable display rack also has merchandise display devices thereon. The movable display rack and fixed display rack are preferably engaged by a track system which permits the movable display rack to move from a first position where it covers the fixed display rack to a second position where it uncovers the fixed display rack and blocks the check-out lane adjacent the merchandiser.

12 Claims, 3 Drawing Sheets

CHECK-OUT COUNTER HAVING A FRONT END MERCHANDISER WITH CHECK-OUT LANE BLOCKER

FIELD OF THE INVENTION

A check-out counter has a front end merchandise display rack positioned at the exit of a retail store at the check-out counter to define a check-out lane. The merchandiser has a display rack which is movable from a first position to a second position in which it blocks the check-out lane. In the second position, a previously hidden merchandise display rack is exposed.

BACKGROUND OF THE INVENTION

Many retail merchandising enterprises permit the customer to move through the stock and select his own merchandise. When the customer has completed his merchandise selection, he moves to the check-out section of the store. Check-out lanes are defined by check-out counters. Each check-out counter provides additional space for the display of merchandise. This merchandise space is on front end merchandisers which are positioned at the store end of the check-out counters. Large stores have a plurality of check-out counters. The number of counters and lanes is a function of the anticipated maximum volume of the store. Since the store does not operate at maximum volume at all times, quite often some of the check-out counters and lanes are closed.

It is most common in present day stores to close the check-out lanes which do not have a check-out clerk operating them. This is to manage outflow of merchandise. Closure is often accomplished by hooking a chain across the inoperative lane. Since such chains are not immediately apparent, quite often a grocery cart is also placed in the closed lane. Such lane barriers are unsightly and constitute an inefficient use of floor space.

SUMMARY OF THE INVENTION

In order to aid in the understanding of this invention, it can be stated in essentially summary form that it is directed to a check-out counter with a front end-merchandiser which includes a check-out lane blocker wherein a display rack on the front end merchandiser is mounted to be movable from a first position away from check-out lane blocking to a second position wherein it blocks the adjacent check-out lane. Preferably, a display rack which is hidden when the movable display rack is in its first position is exposed when the movable display rack is in its second position.

It is thus the purpose and advantage of this invention to provide a check-out counter with a front end merchandiser which has a movable display rack which presents merchandise for sale when in a first position adjacent a check-out lane and is movable to a second position wherein the merchandise is still exposed, but the adjacent check-out lane is blocked.

It is a further purpose and advantage of this invention to provide a check-out counter with a front end merchandiser having a movable display rack with first and second position with the movable display rack configured so that when the movable display rack is in its second position, a merchandising compartment is exposed to present an additional front end merchandising display area.

It is another purpose and advantage of this invention to provide a check-out counter with a front end merchandiser which is conveniently available to the store staff so that a lane can readily be blocked, with the lane blocker comprising a movable display rack on a front end merchandiser so that front end merchandise displays are not obstructed and the front of the store is not rendered unsightly by inferior lane blocking.

It is a further purpose and advantage of this invention to provide a check-out counter with a lane blocker which does not block the check-out lane in its first position, but is movable to block the lane in its second position, and when in the second position, to expose additional merchandise display area.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figures 1, 2, 3, 7:
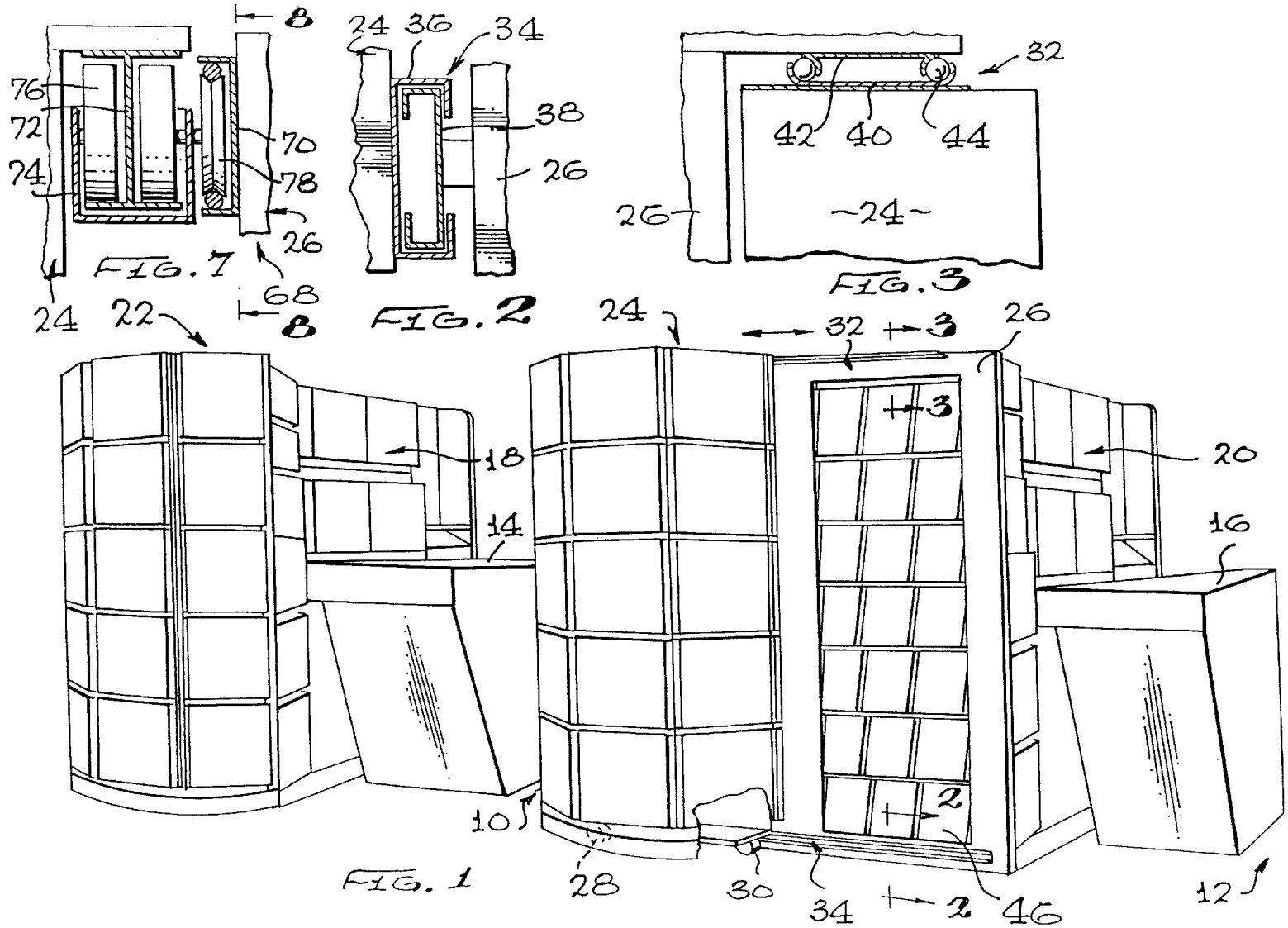
FIG. 1 is a perspective view of two check-out counters with two front end merchandisers with check-out lane blockers in accordance with this invention.
FIG. 2 is an enlarged transverse section through the lower guide rails on the movable display rack of the front end merchandisers, as seen generally along line 2—2 of FIG. 1, with parts broken away.
FIG. 3 is an enlarged transverse section of the top track as seen along line 3—3 of FIG. 1, with parts of the front end merchandiser portions broken away.
FIG. 7 is a transverse sectional through another preferred embodiment of guide rail in accordance with this invention.

FIG. 1 shows first and second check-out lanes 10 and 12. Adjacent these check-out lanes are first and second check-out counters 14 and 16. The check-out counters often have conveyer belts. The customer brings his grocery cart to the store end of the check-out counter, often in a grocery cart. The customer places his merchandise on the counter for check-out by the check-out clerk. Above the check-out counters 14 and 16 are merchandise displays. The backside of these displays are also provided with display space in the adjacent check-out lane. The aisle 10 is thus defined between the check-out counter 14 and the back of merchandise display. Check-out lane 12 is similarly defined. These entire structures comprise front end merchandisers 18 and 20.

Display structures 22 and 24 are movable display racks, respectively, on the merchandise displays 18 and 20. The movable display racks 22 and 24 face the store and thus are seen by the customers who are passing by the check-out counters. It is sometimes necessary to temporarily close one or more of the check-out lanes, usually because customer volume is sufficiently low so that fewer than the maximum number of checkers can adequately take care of their needs. As seen in FIG. 1, front end merchandiser 20 has a front end display rack 26. Display rack structure 24 is movably mounted on the display rack 26 so that it can be moved to the left, as shown on FIG. 1 to substantially close the check-out lane 10. Thus, the display rack 24 is moved from the first position where it covers merchandise display rack 26 to the second position, as shown in FIG. 1, where movable display rack 24 blocks check-out lane 10 and exposes the merchandise display rack 26. The movable display rack 24 can also be moved from the second position back to the first position. The first position is shown for movable display rack 22. Both movable display racks can be moved to the left or to the right, depending on which lane is to be blocked.

Motion of the movable display racks 22 and 24 between their first and second positions is aided by wheels under the movable display racks. Wheels 28 and 30 are shown in FIG. 1. Furthermore, guide systems can be employed between the movable display rack and the fixed portion of the front end merchandiser. Top track 32 and bottom track 34 are shown as interconnecting the movable display rack 24 with the display rack 26 on the front of the front end merchandiser. These tracks or guides can be the same or can be different.

The bottom track 34 is shown in cross-section in FIG. 2. It comprises a C-shaped channel 36 fixed in movable display rack 24. Slidably positioned within the C-shaped channel 36 is rail 38. The rail is attached to the fixed display rack 26. By this structure, the store personnel can laterally move movable display rack 24. When moved to its second position, the movable display rack blocks the adjacent aisle and also exposes the fixed display rack 26. It will be appreciated that such a telescoping arrangement is limited in length. Overlap of the movable display rack 24 over a portion of the fixed display rack 26 is necessary to provide the vertical stability of interlocking tracks. Other rail or track structures can be utilized to permit greater lateral movement of the movable display rack of the front end merchandiser. Such can be accomplished by intermediate members between the guide rail tracks.

The top track 32 may be a telescopic sliding structure like the bottom track 34, but it is preferably an anti-friction sliding structure so that it can support some of the weight of the display structure 24, in addition to the weight supported on the wheels 28 and 30. As is seen in FIG. 3, the top track 32 comprises a fixed ball race 40 which is secured to the top of the front end merchandise display rack 26, which is a fixed structure. The moving ball race 42 is attached to the movable display rack 24 and laterally moves therewith. The plurality of balls 44 between the races provide the anti-friction motion. Suitable ball retainers are employed. Since the top track is under a flange on top of the fixed display rack 26 above the movable display rack 24, the principal part of the load is taken thereon. The bottom track 34 serves as a guide to keep the movable display rack 24 in alignment. The wheels 28 and 30 also support part of the weight of the movable display rack.

This entire structure, including merchandise display 20, fixed display rack 26 and movable display rack 24 comprise the front end merchandiser with the check-out counter. There is a double advantage because movable display rack 24 can be moved to the left to block the lane 10 or moved to the right to block lane 12. It is important to note the second advantage and that is the display compartment 46 is then exposed. When the movable display rack 24 is in the non-lane blocking position, the display compartment 46 is covered. When the movable display rack 24 is moved to the left as shown in FIG. 1, the display compartment 46 is exposed. The front of movable display rack 24 is also provided with equipment so that it can serve to display various merchandise. Thus, when the movable display rack is in its second, lane-blocking position, both of the merchandise displays are visible. The amount of display area on the front end merchandiser is increased. An additional advantage is that neatness prevails. The lane is not blocked by a loaded pallet or a tipped over grocery cart, but is blocked by moving the movable display rack 24 of the front end merchandiser into the second, lane blocking position.

Figure 4:
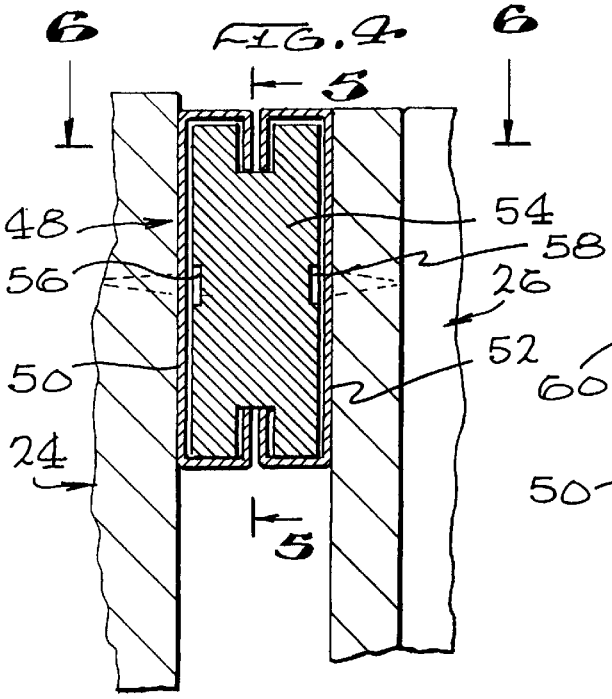
FIG. 4 is a transverse section through another preferred embodiment of guide rail, similar to FIG. 2, with parts broken away.
Figure 5:
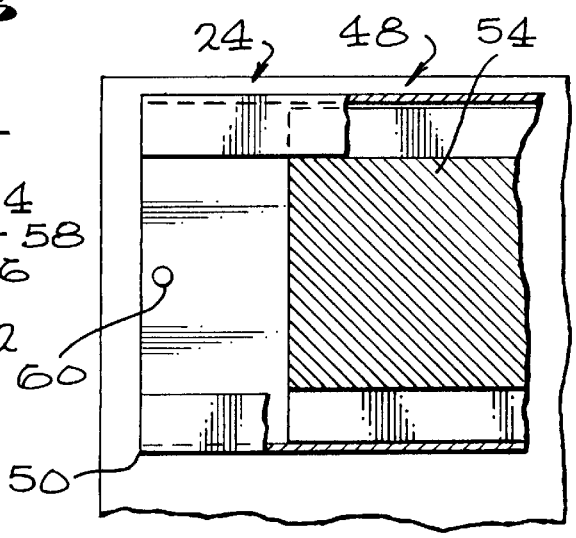
FIG. 5 is a longitudinal sectional as seen generally along line 5—5 of FIG. 4, with parts broken away.
Figure 6:
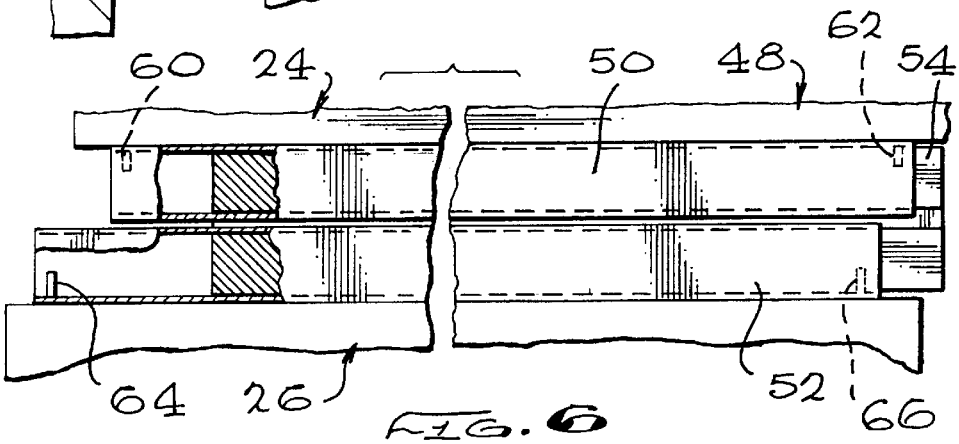
FIG. 6 is a downwardly looking section through the guide rail, as seen generally along the line 6—6 of FIG. 4.

The particular top track 32 and bottom track 34 are examples of the manner in which the movable display rack 24 can be moved laterally with respect to the fixed display rack 26. FIGS. 4, 5 and 6 show another track system, indicated generally at 48, which have tracks 50 and 52 respectively mounted on the movable display rack 24 and display rack 26 as an alternative to the track system comprised of top and bottom tracks 32 and 34. The tracks 50 and 52 are channels within turned flanges to form facing C-shaped facing structures, as is best seen in FIG. 4. These tracks are preferably made of formed sheet metal. Slider 54 has slots in its top and bottom edges which are engaged by the unturned flanges of the C-shaped tracks. The slider is made preferably of low friction material such as brass, polyethylene or low-friction polyesters. Slider 54 is in telescopic sliding relationship with both tracks 50 and 52. Slots 56 and 58 in the sides of slider 54 do not extend the entire length of the slider but have a stop wall at about the mid point of the length of the slider. Stop pins 60 and 62 prevent the slider from sliding more than about halfway out of track 52. Stop pins 64 and 66 prevent the slider from sliding more than about halfway out of the track 50. In this way, the lateral distance in which the movable display rack 24 can slide is limited to about the length of the slider 54. The slider can be as long as, or slightly longer than the tracks. When the movable display rack is in its first position on the front end merchandiser, in the unblocking position, the slider 54 can be slid to the mid position. The track system 48 thus controls and limits the position of the display structure 24 with respect to the remainder of the front end merchandiser.

Figure 8:
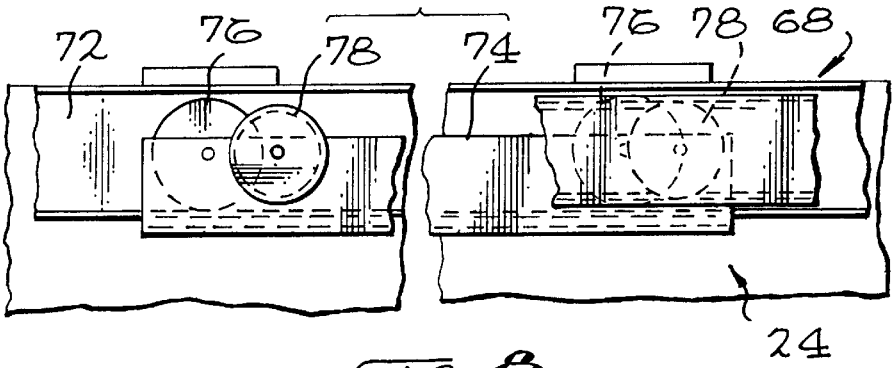
FIG. 8 is a sectional view of the track of FIG. 7 as seen generally along the line 8—8 of FIG. 7.

FIGS. 7 and 8 show a track system 68 which permits the movable display rack 24 to move with respect to fixed display rack 26. The track system 68 is laterally arranged and is suitable for the top track position, similar to the top track 32. The fixed display rack 26 carries a fixed track 70 which is channel-shaped and opened to the left. The movable display stand 24 carries an I-shaped track 72. Channel 74 embraces track 72. A pair of wheels 76 is rotatably mounted in the channel 74 and each wheel is engaged in the I-shaped track 72 on the opposite sides of its center web. As seen in FIG. 8, there are two of the wheels on each side of the web. Channel 74 also carries a pair of wheels 78 rotatably mounted on the outside of the channel. These wheels engage in track 70. With this construction, when movable display rack 24 is laterally moved, the movable display rack 24 runs on the pair of wheels 76. To accommodate full extension, the channel 74 moves half the distance to mutually support the moving display structure 24. The lower track system can be similar or it can be similar to one of the other track structures.

Figure 9:
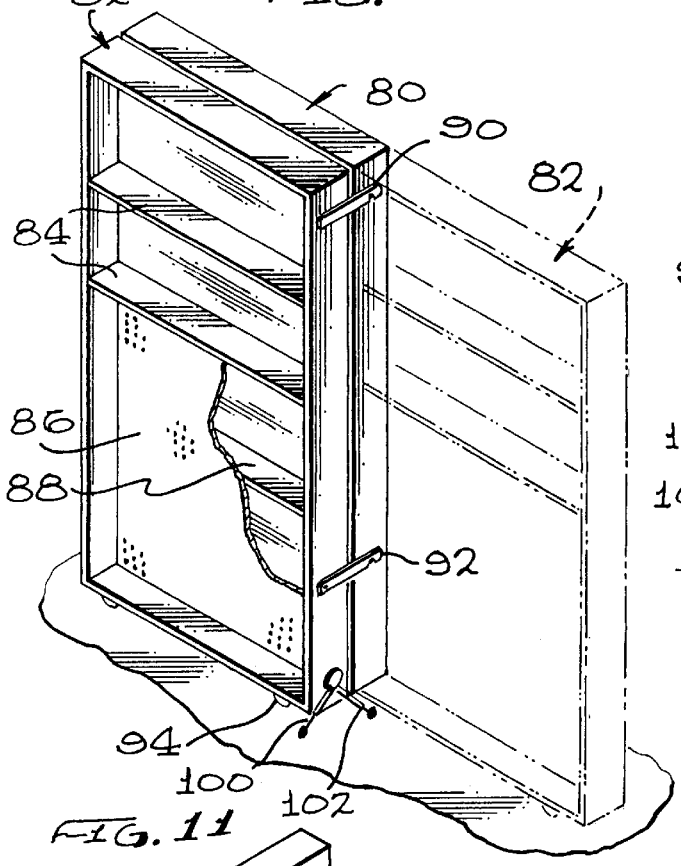
FIG. 9 is a perspective view of another preferred embodiment of the front end merchandiser with check-out lane blocker in accordance with this invention.
Figure 10:
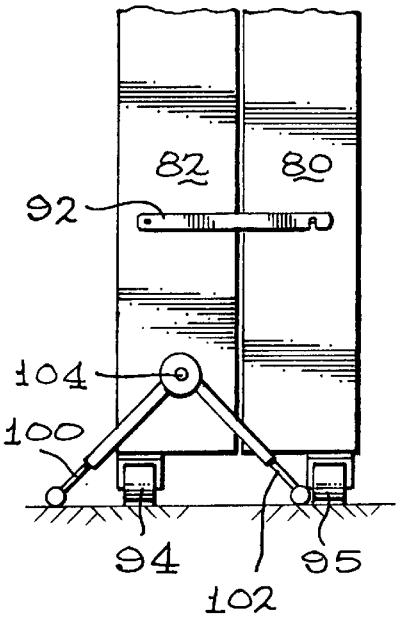
FIG. 10 is an enlarged end view of the front end merchandiser of FIG. 9, shown in the lane unblocked position.
Figure 11:
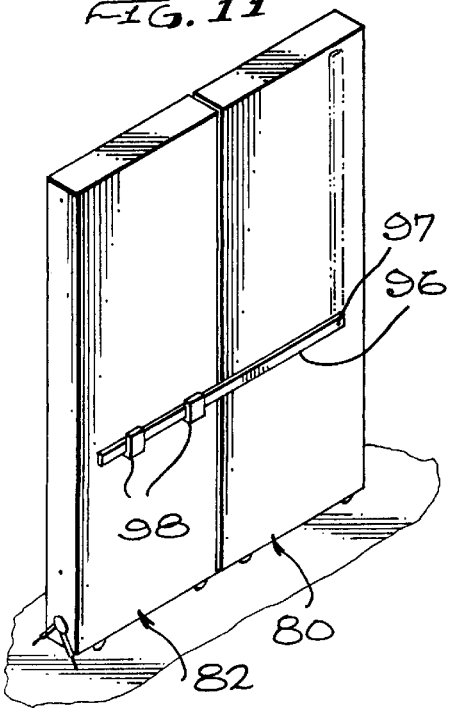
FIG. 11 is a rear perspective view of the front end merchandiser of FIG. 9 in the lane blocker position.

FIGS. 9, 10 and 11 show a portion of a check-out lane counter having a front end merchandiser having a check-out lane blocker. The system shown on these figures comprise a display rack 80 which is a rectangular configuration and has merchandising space in the interior thereof, including shelves, magazine racks, baskets or the like. It is configured to stand as the merchandiser at the front end of a check-out lane. The back rack 80 has associated therewith movable display rack 82. The open front of the movable display rack is seen in FIG. 9. Various merchandising aids are shown therein, such as shelves 84 and peg board 86 into which merchandising pegs may be inserted. Part of the peg board is broken away to show the display space in rack 80, as well as a shelf 88 therein.

The display rack 80 and movable display rack 82 are secured together so that they may be moved together. Securement is by straps 90 and 92, as seen in FIGS. 9 and 10. There are similar straps on the far end. These straps are configured to hook over pins to releasably hold the movable display rack 82 in front of back display rack 80. When held together, the back display rack 80 and movable display structure may be moved by means of rollers, such as rollers 94 and 95 seen in FIG. 10. When the movable display rack 82 is secured in front of the back display rack 80, these racks 80 and 82 can be moved into place to become the front end merchandiser at the check-out lane. The back display rack 80 may be semi-permanently secured in that position, but it is preferably movable into place. When not in the lane-blocking condition, the front of the movable display rack 82 is exposed toward the store.

When lane blocking is desired, movable display rack 82 is released from the front of the back display rack 80 by release of the straps. The movable display rack 82 is moved endwise to block that check-out lane. The movable display rack 82 is moved from the full line position of FIG. 9 to the position shown in dashed lines. This is also the position shown from the rear in FIG. 11. In order to secure the back display rack and movable display rack in place, two securement devices are provided. The first is a bar 96 which is pivoted on pivot point 97 on the back of display rack 80, see FIG. 11. In the locked position, it rests in a pair of brackets 98. This causes the display rack 80 and movable display rack 82 to be in secure alignment. The back display rack 80 and movable display rack 82 are narrow on the front to back direction and it is for this purpose that feet 100 and 102 are provided. These feet are telescopically mounted in support base 104 which is pivotably mounted on the near end of display structure 82, see FIGS. 10 and 11. When in place, the telescopic feet are extended to firmly support the front end merchandiser structure with respect to the floor. In the extended lane-blocking position of FIG. 11, the entire front end merchandising space of both the display rack 80 and the movable display rack 82 are visible. By means of this structure, both functions are achieved, that is, the lane is blocked and hidden merchandise display area of display rack 80 is exposed.

Figure 12:
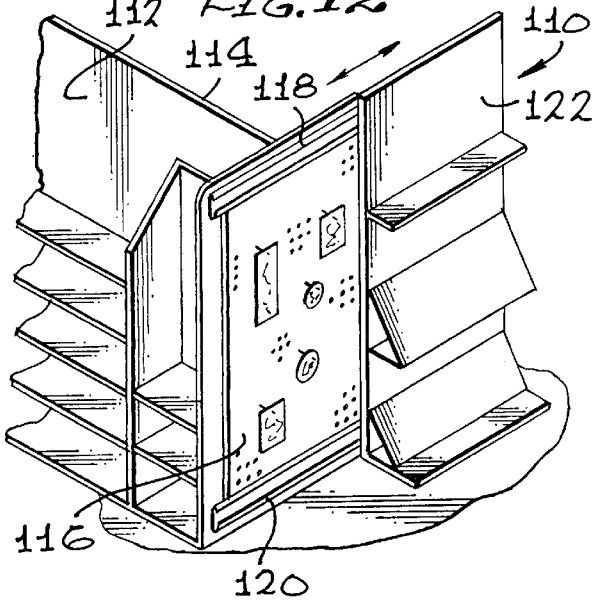
FIG. 12 is a perspective view of another preferred embodiment of the front end merchandiser of this invention, shown in the check-out lane blocker position.

It is thus seen from the two preferred embodiments described thus far that the invention is directed to provide a check-out counter having a front end merchandiser which has a movable portion thereon which moves between a lane blocking and a lane unblocking position. The movable portion has merchandise display equipment thereon for displaying various types of merchandise. When in the lane blocked position, it exposes another merchandise panel or rack so that the moving function accomplishes two purposes: to selectively block the check-out lane and to expose more merchandise space when in the lane blocking position. These ends are further accomplished in a further embodiment of the front end merchandiser of this invention which is generally indicated at 110 in FIG. 12. The merchandiser 112 has the usual display areas 112 and 114 which face the adjacent check-out lanes. The end of that merchandiser has display rack 116 fixed thereon. The display rack has suitable merchandise display devices thereon, such as a peg board or racks. It also has top and bottom tracks 118 and 120 on which the movable display rack 122 is mounted. The portion of the display structure facing into the store also has suitable merchandise display equipment thereon, such as shelves, baskets or hooks, depending upon the type of merchandise to be displayed. In FIG. 12, the movable display rack 122 is shown in the lane-blocking position. In this position, not only is the lane blocked to the right of the front end merchandiser, but the display faces of both the movable display rack 122 and display rack 116 are visible toward the interior of the store. When the moving display structure 122 is moved to the left, it unblocks the lane and covers display rack 116. In this way, lanes are blocked and front end merchandiser space is increased during the blocked stage. The tracks on the movable display rack 122 permit it to be moved either left or right to block either adjacent lane.

This invention has been described in its contemplated best embodiment, and it is clear that it is susceptible to numerous modifications, modes and embodiments within the ability of those skilled in the art and without the exercise of the inventive faculty. Accordingly, the scope of the present invention is defined by the scope of the following claims.

What is claimed is:

1. A front end merchandiser with check-out lane blocker comprising:

a check-out counter for defining a check-out lane adjacent said front end merchandiser;

a merchandise display rack for positioning adjacent the entrance of said check-out lane, said display rack having means thereon for the display of merchandise;

a movable display rack, said movable display rack having means thereon for the display of merchandise, a track structure attached to both said movable display rack and said merchandise display rack, said movable display rack being movably mounted with respect to said merchandise display rack by means of said track structure so that it is movable from a first position where it obstructs access to said means for displaying merchandise on said merchandise display rack to a position where it does not obstruct access to said means for the display of merchandise but blocks said check-out lane adjacent said front end merchandiser, said track structure comprising interengaging sliding members including a slider, said slider being engaged by a track secured to said movable display rack and a track secured to said merchandise display rack.

2. A front end merchandiser comprising:

a check-out counter for defining a check-out lane adjacent said front end merchandiser;

a display rack secured to and forming a portion of said merchandiser, said display rack having means for displaying merchandise thereon, said front end merchandiser having said check-out lane on one side thereof;

a movable display rack, said movable display rack having means for displaying merchandise thereon, said movable display rack being attached to said merchandise display rack to cover at least a portion of said display means on said merchandise display rack when said movable display rack is in a first position with respect to said merchandise display rack, said display structure being positioned to not block the check-out lane adjacent said front end merchandiser when in said first position, said movable display rack being movable to a second position where it blocks said check-out lane adjacent said front end merchandiser and in said second position exposes at least a portion of said display means on said merchandise display rack.

3. The front end merchandiser of claim 2 wherein there is a track system attached to said movable display rack and said merchandise display rack to permit said movable display rack to move between said first and second position.

4. The front end merchandiser of claim 3 wherein said track system includes interengaging rails.

5. The front end merchandiser of claim 3 wherein said track system includes a slider.

6. The front end merchandiser of claim 3 wherein said track system includes anti-friction rotating members.

7. The front end merchandiser of claim 3 wherein there are wheels under said movable display rack to support a portion of its weight as it moves between said first and second positions.

8. The front end merchandiser of claim 3 wherein said movable display rack is substantially as tall as said merchandise display rack so that said merchandise display rack is substantially covered when said movable display rack is in its first position.

9. The front end merchandiser of claim 2 further including a detachable strap between said movable display rack and said merchandise display rack for attaching said movable display rack to said merchandise display rack in said first position and a bar for attaching said movable display rack to said merchandise display rack in said second position.

10. The front end merchandiser of claim 9 wherein there are wheels under both said movable display rack and said merchandise display rack.

11. A front end merchandiser comprising:

a check-out counter for defining a check-out lane;

said front end merchandiser adjacent said check-out counter, said front end merchandiser including a display structure which is visible to persons approaching the check-out lane, and a merchandise display on said display structure for displaying, merchandise to persons in the check-out lane;

a movable display rack, means on said movable display rack for displaying merchandise; and a track structure interengaging said display structure and said movable display rack for permitting movement of said movable display rack from a first position where it at least partially covers said display structure to a second position where it substantially blocks said check-out lane, said track structure comprising interengaging track members having telescopically arranged tracks.

12. The front end merchandiser of claim 11 wherein said tracks have anti-friction rolling members therebetween.

* * * * *